US008385790B2

(12) United States Patent
Aoki et al.

(10) Patent No.: US 8,385,790 B2
(45) Date of Patent: Feb. 26, 2013

(54) TWO-COMPONENT DEVELOPING METHOD AND DEVELOPER USED THEREFOR

(75) Inventors: Mitsuo Aoki, Shizuoka-ken (JP); Hiroyuki Kishida, Shizuoka-ken (JP)

(73) Assignee: Ricoh Company, Limited, Tokyo (JP)

( * ) Notice: Subject to any disclaimer, the term of this patent is extended or adjusted under 35 U.S.C. 154(b) by 297 days.

(21) Appl. No.: 12/948,127

(22) Filed: Nov. 17, 2010

(65) Prior Publication Data

US 2011/0170915 A1 Jul. 14, 2011

(30) Foreign Application Priority Data

Jan. 13, 2010 (JP) ..... 2010-005171

(51) Int. Cl.
*G03G 15/09* (2006.01)

(52) U.S. Cl. ..... 399/274; 399/264; 399/284

(58) Field of Classification Search ..... 399/264, 399/274, 284
See application file for complete search history.

(56) References Cited

U.S. PATENT DOCUMENTS

| | | | | |
|---|---|---|---|---|
| 6,248,488 | B1 | 6/2001 | Kinoshita et al. | |
| 6,782,226 | B2 * | 8/2004 | Machida et al. | 399/285 |
| 7,318,990 | B2 | 1/2008 | Makino et al. | |
| 7,599,650 | B2 | 10/2009 | Katoh et al. | |
| 2001/0012459 | A1 * | 8/2001 | Fujita et al. | 399/103 |
| 2003/0223783 | A1 * | 12/2003 | Yamamoto et al. | 399/284 |
| 2005/0172444 | A1 * | 8/2005 | Carrier | 15/256.51 |
| 2007/0154236 | A1 | 7/2007 | Kwon | |
| 2010/0215410 | A1 * | 8/2010 | Ito et al. | 399/284 |

FOREIGN PATENT DOCUMENTS

| | | |
|---|---|---|
| CN | 1959556 A | 5/2007 |
| CN | 1991620 A | 7/2007 |
| JP | 2981803 | 9/1999 |
| JP | 3168366 | 3/2001 |
| JP | 3351347 | 9/2002 |
| JP | 3696404 | 7/2005 |
| JP | 2005-274756 | 10/2005 |

OTHER PUBLICATIONS

Chinese Office Action issued Mar. 7, 2012, in Patent Application No. 201110006413.7.

* cited by examiner

*Primary Examiner* — David Gray
*Assistant Examiner* — G.M. Hyder
(74) *Attorney, Agent, or Firm* — Oblon, Spivak, McClelland, Maier & Neustadt, L.L.P.

(57) ABSTRACT

A two-component developing method, including regulating a two-component developer borne on a developer bearer with a doctor blade; and transferring the regulated two-component developer to the developer bearer to develop a latent image on an image bearer, wherein the two-component developer includes a pulverized toner having a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number, and wherein the doctor blade has a surface regulating the developer at an upstream side relative to a rotational direction of the developer bearer, which has a surface roughness Ra not greater than 0.2 μm.

14 Claims, 4 Drawing Sheets

TWO-COMPONENT DEVELOPING METHOD AND DEVELOPER USED THEREFOR

BACKGROUND OF THE INVENTION

1. Field of the Invention

The present invention relates to a two-component developing method regulating a two-component developer on a developer bearer with a regulation member, i.e., a doctor blade, and transferring the two-component developer after regulation onto a latent image on an image bearer to develop the latent image.

2. Description of the Background Art

Typically, in electrophotographic image forming apparatuses such as copiers, printers, and facsimiles, an electrostatic latent image is formed on an image bearer such as photoreceptor drums and belts according to image information and an image developer develops the electrostatic latent image to form a visual image.

In an image developer using a magnetic brush developing method with a two-component developer, the two-component developer forms brush-chain-shaped ears on a developer bearer, and a toner in the developer is fed onto the latent image on the image bearer in a developing area where the magnetic brush contacts the image bearer.

The developer bearer is typically formed of a cylindrically-shaped sleeve (developing sleeve), and includes a magnetic material (magnetic roller) forming a magnetic field so as to form ears of developer on the surface thereof. Ears of carrier are formed on the sleeve along magnetic lines of force generated by the magnetic roller, and charged toner adheres to the carrier. The magnetic roller has multiple magnetic poles, with stick-like magnets forming the respective magnetic poles. In particular, the magnetic roller has a main magnetic pole used for developing, which attracts developer at a developing area on the surface of the sleeve and causes the developer to stand up on end like ears of grain. When either the sleeve or the magnetic roller moves, ears of developer on the surface of the sleeve move. The regulation member, i.e., the doctor blade, contacts the ears of a developer to give them an even height and an even quantity and transfers them and to the image bearer.

Developer transferred to the developing area forms ears along magnetic lines of force generated by the developing main magnetic pole, and the resultant chain ears of the developer flexibly contacts the surface of the latent image bearer. The chain ears of the developer feeds toner to (that is, develops) an electrostatic latent image in friction therewith, based on a relative linear speed difference with the latent image bearer.

Toner fusing to the doctor blade occasionally causes imaging problems.

Toner or foreign particles adhering to melted toner adheres to the doctor blade and changes the size of a gap between the developer bearer and the doctor blade, and the amount of the developer is not uniformly regulated, resulting in imaging problems such as background fouling (foggy images) and striped images. The exact diameter of the toner largely determines whether and to what extent the toner fuses to the doctor blade. Toner that includes a large amount of fine powdery toner is more likely to cause the toner to fuse to the doctor blade. Fine powdery toner is, e.g., toner having a small particle diameter; i.e., not greater than 2 μm.

The precise mechanics of fusing are as follows. Fine powdery toner is likely to enter concavities of the doctor blade, and the toner remaining on the surface thereof, being vulnerable to a heat, is melted by the heat of the doctor blade. Toner as well as paper powder further adhere to the toner melted on the surface of the doctor blade, resulting in build-up of a large amount of extraneous matter.

The amount of fine powdery toner having a small particle diameter which is included it he toner as a whole can be decreased to prevent the toner fusion bond to the doctor blade. However, toner having a small particle diameter is advantageously used to produce quality images, and consumes less heat energy when fixed. In short, toner having a small particle diameter is advantageous in that it can be used to produce quality images and save energy, but which tends to anchor to the doctor blade.

There are suggested methods of reversing the developer bearer, etc., to prevent toner fusing to the doctor blade and adherence of foreign particles thereto.

Typically, as Japanese published unexamined application No. 2005-274756 discloses, toner fusion to the doctor blade often occurs in one-component developing methods, in which the doctor blade regulates a layer thickness of a developer while pressed against a developing roller. In this case, the type of material used for the part of the doctor blade that contacts the developing sleeve and its surface roughness are controlled to prevent toner fusion.

Japanese Patent No. 3696404 discloses a method of regulating a surface roughness of the end of the regulation member facing an image bearer so as to smoothly regulate the layer thickness of a two-component developer with a sufficient rectification effect on the fluidity of the developer. However, the purpose and effect of this approach is strictly to improve rectificability of the developer, and thus the object thereof is different from that of the present invention.

Japanese Patent No. 2981802 discloses a toner including particles having a particle diameter not greater than 4.0 μm in an amount of from 20 to 40% by number, and particles having a particle diameter of from 4.0 to 8.0 μm in an amount not less than 60% by number. However, the content of particles having a particle diameter not greater than 2.0 μm is not disclosed.

Similarly, Japanese Patent No. 3168366 discloses a toner including particles having a particle diameter not greater than 4.0 μm in an amount of from 10 to 70% by number, and particles having a particle diameter not greater than 5.0 μm in an amount not less than 40% by number. However, here too the content of particles having a particle diameter not greater than 2.0 μm is not disclosed.

Japanese Patent No. 3351347 discloses a toner including particles having a volume-average particle diameter of from 2.0 to 5.0 μm and a particle diameter not greater than 5.0 μm in an amount not less than 90% by number, and particles having a particle diameter not greater than 1.0 μm in an amount not greater than 20% by number. However, again, the content of particles having a particle diameter not greater than 2.0 μm is not disclosed.

For these reasons, a need exists for a two-component developing method, an image developer, and a developer capable of producing high-quality images, having low-temperature fixability, and preventing the toner from fusing to the doctor blade.

SUMMARY OF THE INVENTION

Accordingly, an object of the present invention is to provide a two-component developing method, capable of producing high-quality images, having low-temperature fixability and preventing the toner fusion bond to the doctor blade.

Another object of the present invention is to provide an image developer capable of producing high-quality images, having low-temperature fixability and preventing the toner fusion bond to the doctor blade.

A further object of the present invention is to provide a developer used in the two-component developing method and the image developer.

Another object of the present invention is to provide a doctor blade having abrasion resistance.

These objects and other objects of the present invention, either individually or collectively, have been satisfied by the discovery of a two-component developing method, comprising:

regulating a two-component developer borne on a developer bearer with a doctor blade which is a regulation member; and transferring the regulated two-component developer to the developer bearer to develop a latent image on an image bearer, wherein the two-component developer includes a pulverized toner having a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number, and wherein the doctor blade has a surface regulating the developer at an upstream side relative to a rotational direction of the developer bearer, which has a surface roughness Ra not greater than 0.2 μm.

Further, the doctor blade is formed of aluminum subjected to alumite treatment.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The present invention provides a two-component developing method, capable of producing high-quality images, having low-temperature fixability and preventing the toner fusion bond to the doctor blade.

Particularly, the present invention relates to a two-component developing method, comprising:

regulating a two-component developer borne on a developer bearer with a doctor blade which is a regulation member; and transferring the regulated two-component developer to the developer bearer to develop a latent image on an image bearer, wherein the two-component developer includes a pulverized toner having a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number, and wherein the doctor blade has a surface regulating the developer at an upstream side relative to a rotational direction of the developer bearer, which has a surface roughness Ra not greater than 0.2 μm.

Figure 1:
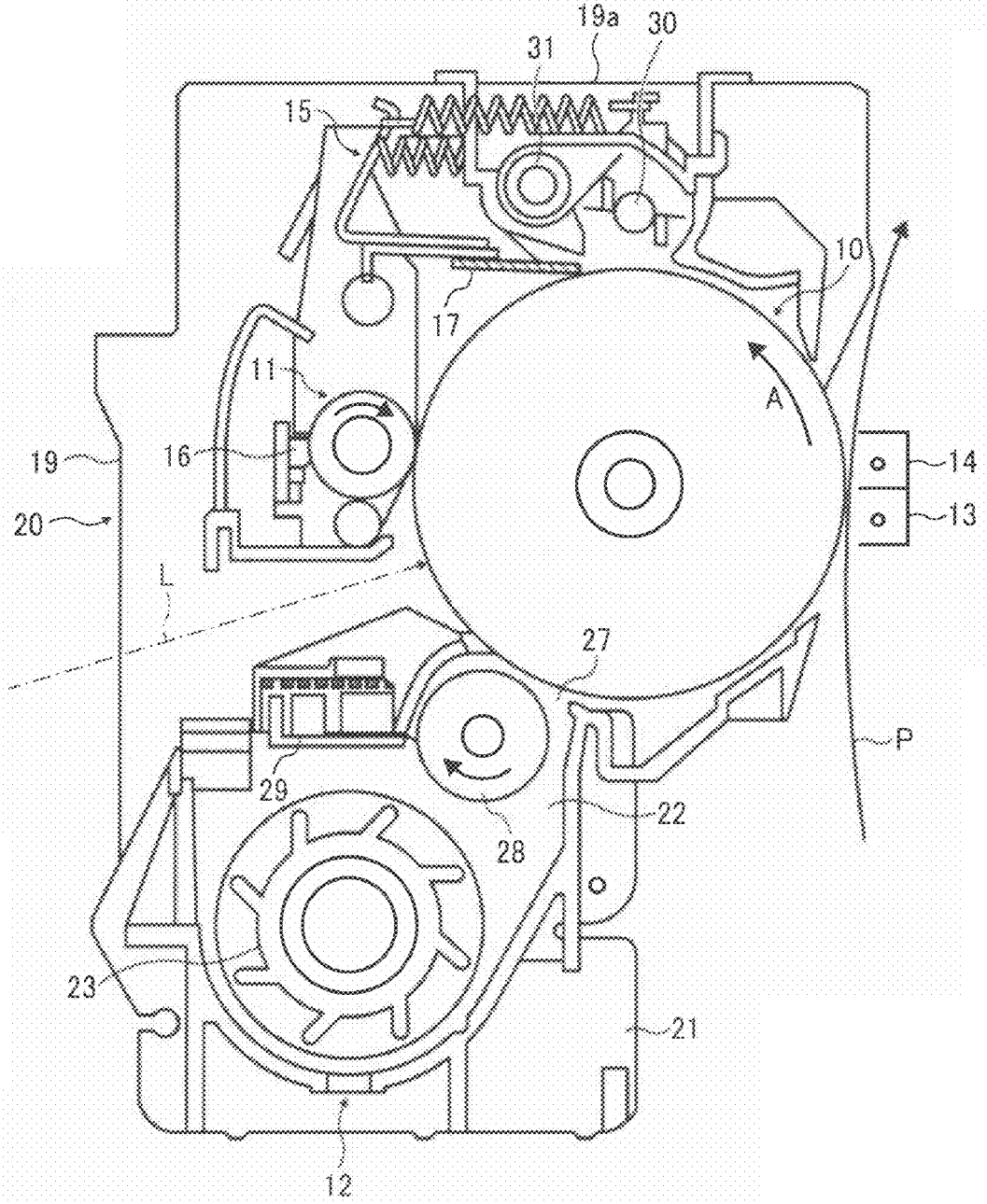
FIG. 1 is a schematic view illustrating a main component of an embodiment of the image forming apparatus of the present invention.

Hereinafter, embodiments of the present invention will be explained, referring to the drawings. FIG. 1 is a schematic view illustrating a main component of an embodiment of the image forming apparatus of the present invention.

In FIG. 1, numeral 10 is a drum-shaped photoreceptor which is an image bearer. As FIG. 1 shows, around the photoreceptor 10, from a roller-shaped charger 11 beside the photoreceptor, in order of a rotational direction indicated by an arrow A of the photoreceptor 10, an image developer 12 is arranged below, a transferer 13 and a paper separator 14 are arranged beside, and a cleaner 15 is arranged above.

An original is placed on a contact glass (not shown) as known, and when the apparatus is switched on to produce a copy, an optical reader (not shown) reads an image of the original, and at the same time, a paper (transfer material) P is fed between the photoreceptor 10 and the transferer 13.

Meanwhile, the photoreceptor 10 rotates at a predetermined peripheral speed, a charger 11 cleaned by a cleaning pad 16 evenly charges the surface of the photoreceptor in accordance with the rotation. An irradiator (not shown) irradiates the surface thereof with laser beam (L) to form an electrostatic latent image of the image read on the photoreceptor 10. When the photoreceptor 10 passes the image developer 12, a toner adheres to the electrostatic latent image to be visualized. The visualized toner image is transferred by the transferer 13 onto the paper P fed between the photoreceptor 10 and the transferer 13.

The paper P electrostatically adhering to the photoreceptor 10 separates therefrom with a discharge from the paper separator 14, and transfers to a fixer (not shown) where the transferred image is fixed on the paper P and discharges to a paper discharge part (not shown). Instead of the paper separator 14, a separation click may be used to mechanically separate the paper P from the photoreceptor 10.

Meanwhile, after a residual toner remaining on the photoreceptor 10 after transferring a toner image is scraped off with a cleaning blade 17 of the cleaner 15, the photoreceptor is discharged with a discharge lamp (not shown) such that the surface potential thereof is initialized.

Figure 2:
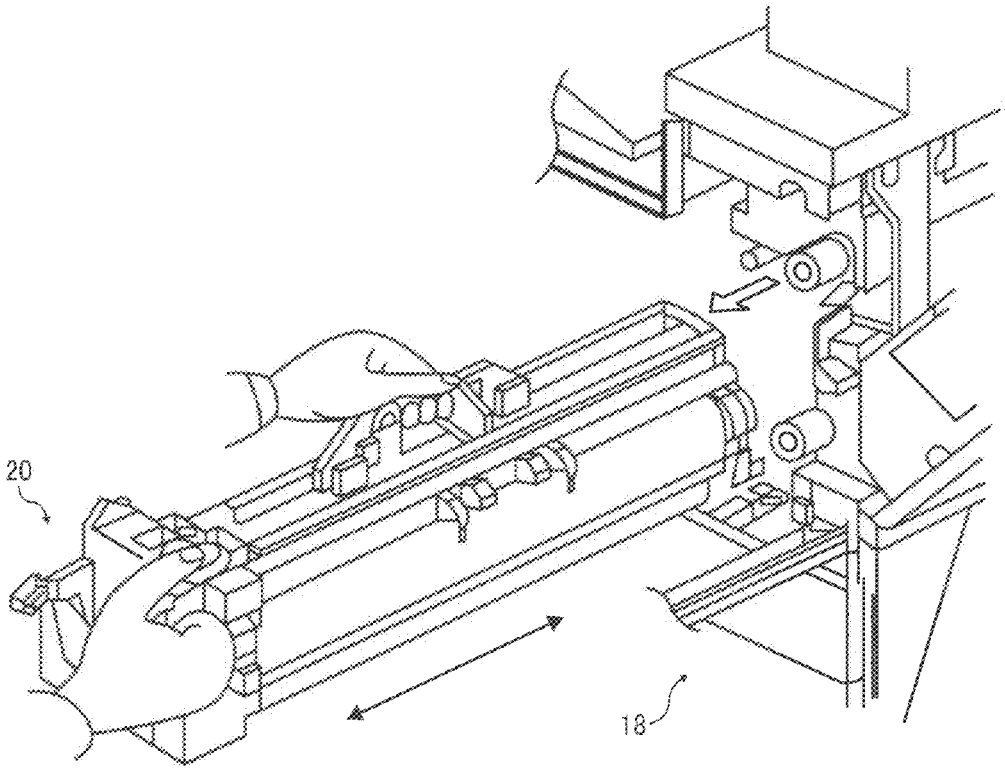
FIG. 2*a* schematic view illustrating an embodiment of the process cartridge of the present invention.

The photoreceptor 10, the charger 11, the image developer 12 and the cleaner 15 are integrated into one cartridge case 19 to form a process cartridge 20. The process cartridge 20 is taken in and out in the direction of an arrow and detachable from an image forming apparatus 18 as shown in FIG. 2.

In the process cartridge 20, the image developer 12 includes a developer container 21 below and a developer bearer 22 below as shown in FIG. 1. The developer container 21 contains a dry two-component developer including a carrier and a toner, and includes a stirring member 23 transferring the developer while stirring the developer. In addition, the developer container 21 includes a toner concentration sensor detecting a mixing ratio of the toner and the carrier in the developer.

The developer bearer 22 has a developing sleeve (developer bearing member) 28 including a magnet at a position facing the photoreceptor 10 through a developing window 27, and has a developing doctor (developer regulation member) 29 regulating an amount of a developer fed to the photoreceptor 10.

Figure 3:
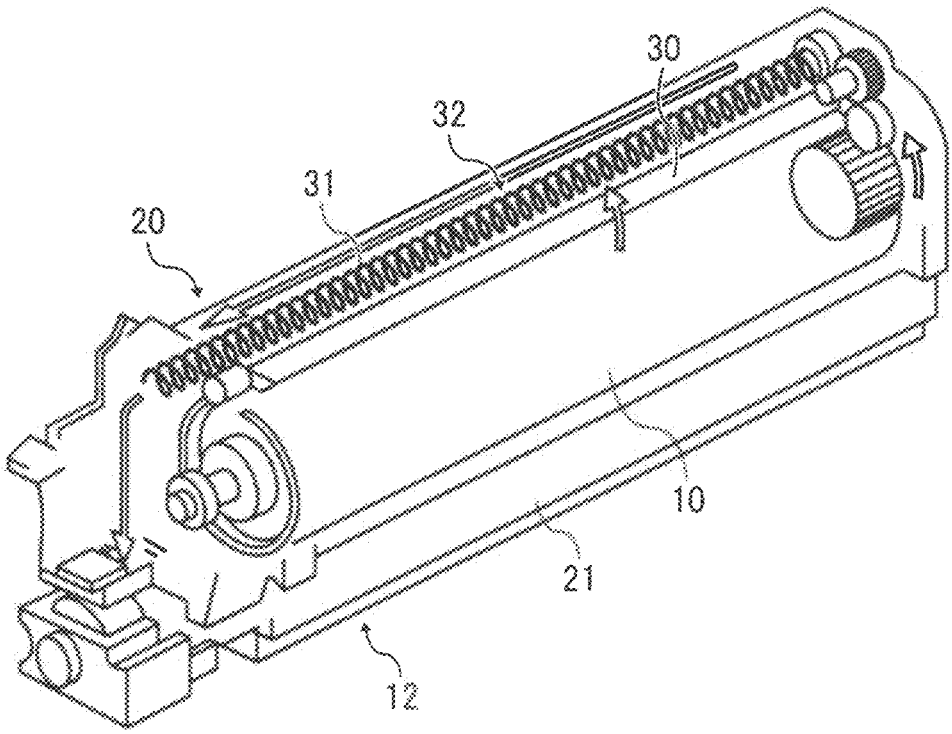
FIG. 3 is a schematic view for explaining an embodiment of recycle means for recycling a residual toner in the image developer of the present invention.

In the cleaner 15 above the photoreceptor 10, the cartridge case 19 has a cleaning case 19*a* including a collection blade 30 scraping up a residual toner scraped off by the cleaning blade 17, and a coil-shaped toner feed member 31 feeding the scraped-up toner by the collection blade 30 in an axial direction of the photoreceptor 10 as shown in FIG. 3.

The process cartridge 20 further has a toner recycler 32 returning a toner collected by the cleaner 15 to the toner container 21 of the image developer 12 through a feed path formed of a pipe, etc., using a feed member such as screws, coils and belts or gravity.

In the image developer 12, a drive motor (not shown) is driven to rotate the developing sleeve 28 and the stirring member 23 to stir a developer, and which is fed to the developing sleeve 28 while the toner and the carrier included in the developer are frictionally charged. Meanwhile, a predetermined bias is applied to the developing sleeve 28 to electrostatically transfer the toner in the developer to the surface of the photoreceptor 10 such that a latent image on the surface thereof is visualized.

In the cleaner 15, the rotation of the photoreceptor 10 is transmitted to the toner feed member 31 through a gear to be rotationally driven. The toner feed member 31 collects a residual toner removed from the photoreceptor 10 on the near side of the cleaning case 19*a*, and the toner recycler 32 returns the toner to the image developer 12.

Figure 4:
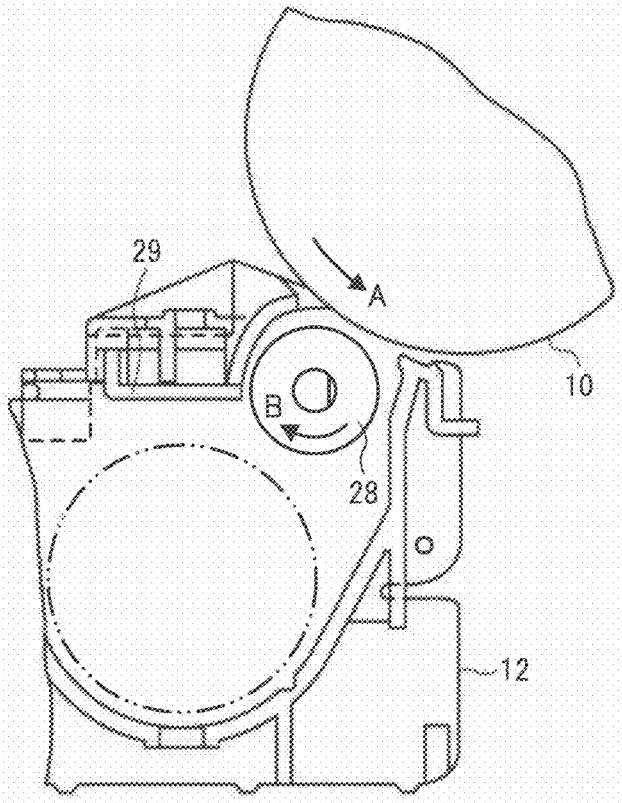
FIG. 4 is a schematic view illustrating an embodiment of the process cartridge including the image developer of the present invention.

FIG. 4 is an enlarge view of a part of the image developer 12 of the process cartridge 20.

As FIG. 4 shows, in the image developer 12, the photoreceptor 10 which is an image bearer rotates in the direction of an arrow A (anticlockwise), and the developing sleeve 28 rotates in the direction of an arrow B (clockwise).

The edge of the doctor blade 29 which is a developer regulation member faces the developing sleeve 28.

The edge of a thin metallic plate is folded to have an L-shaped cross-section to form the doctor blade 29, which is horizontally located along an axial direction of the developing sleeve 28, and both ends of doctor blade 29 are supported by support plates (not shown).

Figure 5:
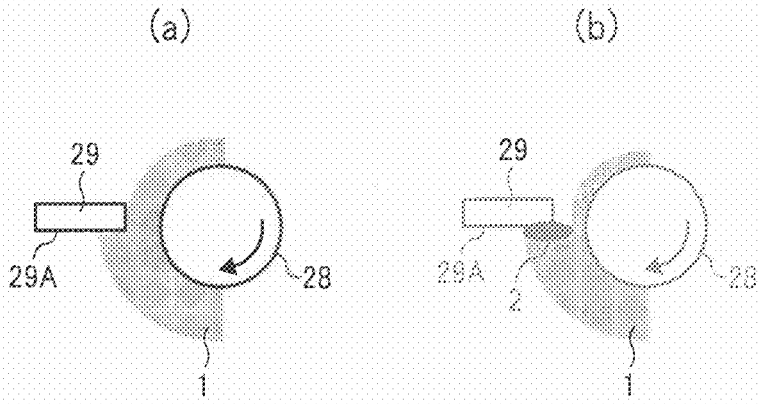
FIG. 5 is a schematic view for explaining when a foreign particle anchors to the developing doctor.

FIG. 5 shows simple cross-sectional views illustrating the developing sleeve and the doctor blade. An image developer in (a) regulates a pumped amount of a developer with the doctor blade and feeds a proper amount of the developer.

A toner anchors on the surface of the doctor blade of an image developer (b), where a developer at an upstream side of the doctor blade relative to a rotational direction of the developing sleeve of the doctor blade is regulated. When a large amount of a toner anchors on the doctor blade, a pumped amount of the developer decreases only at a part where a toner anchors. When the pumped amount of the developer decreases, images having low image density and striped images are produced. Further, the scavenge power lowers, resulting in background fouling (foggy images).

When the doctor blade is formed of a magnetic material, a developer magnetized by the developing sleeve adheres to the surface of the blade, the fluidity of the developer on the sleeve deteriorates and the developer is likely to anchor thereon. The magnetic doctor blade typically uses a magnetic force of a mag roller included in the developing sleeve, and ears of the magnetic brush stand up and a pressure of a toner to the doctor blade is small. In the meantime, ears of a magnetic brush of a non-magnetic doctor blade lie. Therefore, a pressure of a toner to the doctor blade is large, and the toner is likely to anchor thereon.

The metallic material occasionally has surface roughness or stripes in a direction perpendicular to a flow of a developer due to punching dies or extrusion, resulting in gathering of a toner.

Therefore, the non-magnetic doctor blade preferably has a small surface roughness of a surface regulating a developer at an upstream side of the blade to increase slippage of a toner. The surface of an ear-cut of the edge of the doctor blade needs to have no abrasion due to contact with hard materials in a developer even when used for long periods of time. In consideration of these, the doctor blade needs to be formed of a non-magnetic material having a sufficient surface hardness. Therefore, non-magneticmetallic materials such as Al, Cu, SUS304, SUS316L and SUSXM7 are used for the doctor blade.

However, a doctor blade made of Al has low a Vickers hardness of from HV 60 to 70, which is easily abraded.

Therefore, the surface of Al is treated with alumite to have a Vickers hardness not less than HV 200 so as not to be abraded.

The level of the toner fusion bond is largely different according to an amount of fine powders of a toner.

Particularly, the content of a toner having a particle diameter not greater than 2.0 μm largely influences on the toner fusion bond. An average particle diameter has no relation.

A toner needs to have a small particle diameter to produce high-quality images, and the content of a toner having a particle diameter not greater than 4.0 μm contributes to production of high-quality images.

When the content of a toner having a particle diameter not greater than 2.0 μm is not less than 10% by number, even if a surface regulating the developer at an upstream side of the doctor blade has a surface roughness Ra not greater than 0.2 μm, a toner fusion bond to the doctor blade still occurs.

When the content of a toner having a particle diameter not greater than 4.0 μm is not greater than 30% by number, high-quality images are difficult to produce.

Namely, a toner needs to include particles having a particle diameter not greater than 2.0 μm in an amount not greater than 10% by number and particles having a particle diameter not greater than 4.0 μm in an amount not less than 30% by number so as to produce high-quality images without fusion bond to the doctor blade.

It is difficult by ordinary pulverization and classification methods to produce the pulverized toner of the present invention at a high yield rate, which has a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number. Therefore, setup of pulverization and classification conditions is essential.

The fine powdery toner is measured by FPIA-2100 from SYSMEX CORPORATION and an analysis software FPIA-2100 Data Processing Program for FPIA version 00-10 was used. Specifically, 0.1 to 0.5 g of the toner and 0.5 ml of a surfactant (alkylbenzenesulfonate Neogen SC-A from Daiichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser from HONDA ELECTRONICS CO., LTD. for 3 min. The circularity of the toner was measured by FPIA-2100 until the dispersion has a concentration of from 5,000 to 15,000 pieces/μl, which is essential in terms of measurement reproducibility of the average circularity. In order to obtain the concentration, it is necessary to control added amounts of the surfactant and the toner. The amount of the surfactant depends on the hydrophobicity of the toner. When too much, bubbles cause noises. When short, the toner is not sufficiently wetted and not sufficiently dispersed. The amount of the toner depends on the particle diameter thereof. When small, the amount needs to be less. When large, the amount needs to be more. When the toner has a particle diameter of from 3 to 10 μm, the amount thereof is 0.1 to 0.5 g such that the dispersion has a concentration of from 5,000 to 15,000 pieces/μl.

Any known binder resins can be used in the toner of the present invention. Specific examples of the resins include styrene resins such as styrene, poly-α-methylstyrene, styrene-chlorostyrene copolymers, styrene-butadiene copolymers, styrene-vinylchloride copolymers, styrene-vinylacetate copolymers, styrene-maleic acid copolymers, styrene-ester acrylate copolymers, styrene-α-methylchloroacrylate copolymers and styrene-acrylonitrile-ester acrylate copolymers (polymers or copolymers including styrene or styrene substituents); polyester resins; epoxy resins; vinylchloride resins; rosin-modified maleic acid resins; phenol resins; polyethylene resins; polypropylene resins; petroleum resins; polyurethane resins; ketone resins; ethylene-ethylacrylate copolymers, xylene resins; and polyvinylbutyral resins.

Methods of preparing these resins are not particularly limited, and any of bulk polymerization methods, solution polymerization methods, emulsion polymerization methods and suspension polymerization methods can be used.

Particularly, polyester resins are preferably used in the present invention. The polyester resin typically has more low-temperature fixability than other resins while having thermostable storageability.

The polyester resin can be obtained from a condensed polymerization between alcohol and a carboxylic acid. Specific examples of the alcohol include glycols such as ethyleneglycol, diethyleneglycol, triethyleneglycol and propyleneglycol; etherifiedbisphenol such as 1,4-bis (hydroxymethyl)cyclohexane and bisphenol A; units obtained form a dihydric alcohol monomer; and units obtained from a tri-or-more hydric alcohol monomer.

Specific examples of the carboxylic acids include units obtained from a dihydric organic-acid monomer such as maleic acid, fumaric acid, phthalic acid, isophthalic acid, terephthalic acid, succinic acid and malonic acid; and units obtained from a tri-or-more hydric carboxylic-acid monomer such as 1,2,4-benzenetricarboxylic acid, 1,2,5-benzenetricarboxylic acid, 1,2,4-cyclohexanetricarboxylic acid, 1,2,4-naphthalanetricarboxylic acid, 1,2,5-hexanetricarboxylic acid, 1,3-dicarboxyl-2-methylenecarboxypropane and 1,2,7,8-octantetracarboxylic acid. The polyester resin preferably has a glass transition temperature Tg of from 58° C. to 75° C.

Known colorants for each color, i.e., yellow, magenta, cyan and black can be used in the present invention. Specific examples of yellow toner colorants include azo pigments such as C.I. (color index) Pigment Yellow 1, C.I. Pigment Yellow 5, C.I. Pigment Yellow 12, C.I. Pigment Yellow 15 and C.I. Pigment Yellow 17; inorganic pigments such as yellow iron oxide and Chinese yellow; and dyes, e.g., nitro dyes such as C.I. Acid Yellow 1, and oil-soluble dyes such as C.I. Solvent Yellow 2, C.I. Solvent Yellow 6, C.I. Solvent Yellow 14, C.I. Solvent Yellow 15, C.I. Solvent Yellow 19 and C.I. Solvent Yellow 21. Particularly, benzidine pigments such as C.I. Pigment Yellow 17 is preferably used in terms of color.

Specific examples of magenta toner colorants include C.I. Pigment Red 49, C.I. Pigment Red 57, C.I. Pigment Red 81, C.I. Pigment Red 122, C.I. Solvent Red 19, C.I. Solvent Red 49, C.I. Solvent Red 52, C.I. Basic Red 10 and C.I. Disperse Red 15. Particularly, quinacridone pigments such as C.I. Pigment Red 122 is preferably used in terms of color.

Specific examples of cyan toner colorants include C.I. Pigment Blue 15, C.I. Pigment Blue 16, C.I. Solvent Blue 55, C.I. Solvent Blue 79, C.I. Direct Blue 25 and C.I. Direct Blue 86. Particularly, copper-phthalocyanine pigments such as C.I. Pigment Blue 15 is preferably used in terms of color.

Carbon black is preferably used as a black toner colorant. Any known carbon blacks, such as channel black, rohs black, disc black, gas furnace black, oil furnace black, and acetylene black, can be used.

Release agents for use in the present invention include natural waxes, e.g., animal waxes such as a bees wax, a whale wax and a shellac wax; plant waxes such as a carnauba wax, a Japan wax, a rice wax and a candelilla wax; petroleum waxes such as a paraffin wax and a microcrystalline wax; mineral waxes such as a montan wax and an ozokerite; and synthesized waxes such a Fischer-Tropsch wax, a polyethylene wax, a fatty synthesized waxes (ester, ketone and amide) and a hydrogenated wax. The release agent preferably has an endothermic peak of from 80 to 110° C. when measured by a differential scanning calorimeter (DSC) to execute an exuding effect at low temperature.

The release agents are not particularly limited, but hydrocarbon synthesized waxes or petroleum waxes are preferably used. The hydrocarbon synthesized waxes are broadly classified into the following two waxes. One is Fischer-Tropsch wax, produced by reaction between carbon oxide and hydrogen. The other is polyethylene wax, produced by polymerization of ethylene or thermodecomposition of polyethylene.

The endothermic peak is measured by DSC according to JIS-K7122-1987, and which is a melting point.

Further, the wax for use in the present invention preferably has a polarity, and more preferably has an acid value of from 3 to 8 KOH/mg/g. A wax can have a polarity when chemically or physically converted or modified. The modified waxes are broadly classified into oxidized waxes and blended waxes blended with synthesized resins, etc. A wax is oxidized with chemicals or oxygen in the air to prepare the oxidized wax. A wax is blended with a suitable amount of synthesized resins such as ethylenevinylacetate copolymers, polyethylene and synthesized rosin for reinforcing the mechanical strength of the wax to prepare the blended wax.

The release agents for use in the present invention preferably has a penetration not greater than 4. The penetration is hardness of the release agent, measured by a method specified in JIS standard (K-2235-5.4). A weight of 100 g is loaded on a needle under a specified temperature, and how many mm the needle penetrates a sample for 5 sec is measured. The result is decupled.

The toner of the present invention may include a charge controlling agent for the purpose of controlling the friction chargeability of the toner. The charge controlling agent includes a positive-charge controlling agent and a negative-charge controlling agent. Specific examples of the positive-charge controlling agent include organic compounds having a basic nitrogen atom such as basic dyes, quaternary ammonium salts, aminopyrine, pryimidine compounds, multinucleatedpolyamino compounds, aminosilanes and nigrosine base. Specific examples of the negative-charge controlling agent include oil-soluble dyes such as oil black and spirone black, azo dyes including a metal, metal naphthenate, metal alkylsalicylate, fatty acid soaps and resin acid soaps. The toner preferably includes the charge controlling agent in an amount of from 0.1 to 10 parts by weight, and more preferably from 0.5 to 8 parts by weight per 100 parts by weight of a binder resin. The colorless quaternary ammonium salts or metal alkylsalicylate is preferably used for color toners, but are not indispensable.

The toner of the present invention may include an external additive such as silica, other inorganic particulate materials and particulate resins. Specific examples of the other inorganic particulate materials besides silica include metal salts of fatty acid, zinc stearate, calcium stearate, lead stearate, powdery zinc oxide, powdery aluminum oxide and powdery titanium oxide. Specific examples of the particulate resins include melamine resins and acrylic resins.

Known mixers such as HENSCHEL MIXERS and SUPER MIXERS can be used to mix the additive with a mother particle.

The toner of the present invention preferably has an average particle diameter of from 3 to 6 μm.

A method of preparing the toner of the present invention include a process of mixing materials, a process of kneading, a process of cooling, a process of crushing, a process of pulverizing, a process off classifying, and a process of mixing an additive with mother particles after the process of classifying.

In the present invention, at least a binder resin, a colorant and a release agent are mixed to prepare a mixture, and the mixture is kneaded by a kneader such as closed continuous kneaders and open roll kneaders to prepare a kneaded mixture.

The kneaded mixture is cooled, crushed by a crusher such as Rotoplex and pulverizers, pulverized by a pulverizer such as air jet mills and mechanical pulverizers, and classified by a classifier such as air stream classifiers and rotor classifiers to prepare mother particles.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were melted and kneaded by a uniaxial extruder to prepared a kneaded mixture, the kneaded mixture was cooled and solidified to prepare a solidified mixture, and the solidified mixture was pulverized to prepare a pulverized mixture, and the pulverized mixture was classified to prepare a classified toner of Example 1.

Polyester Resin A 40

(prepared by reacting bisphenol A propylene oxide adduct, bisphenol A ethylene oxide adduct, fumaric acid and trimellitic acid, and having a softening point of 146° C., an acid value of 28 and a glass transition temperature (Tg) of 60° C.)

Polyester Resin B 40

(prepared by reacting bisphenol A propylene oxide adduct and terephthalic acid, and having a softening point of 100° C., an acid value of 15 and a Tg of 59° C.)

Carnauba Wax 5

(having a melting point of 83° C., an acid value of 4.0 and a saponification value of 90)

Bontron E-304 1

(from Orient Chemical Industries Co., Ltd.)

Carbon Black 13

(#44 from Mitsubishi Chemical Corp.

The classified toner of Example 1 had a volume-average particle diameter of 5.5 μm, included particles having a particle diameter not greater than 4.0 μm in an amount of 35% by number, and particles having a particle diameter not greater than 2.0 μm in an amount of 8% by number.

1.0 part of silica (R-972 from Clariant Japan K.K.) was mixed with the classified toner to prepare a toner of Example 1.

The developing doctor in imagio MP5000 from Ricoh Company, Ltd. was modified to be a steel(iron)-formed doctor having a surface roughness Ra of 0.19, and 100,000 images were continuously produced thereby with the toner of Example 1 when the doctor had a highest temperature.

Even though MP5000 has a toner recycler, the recycler was off in Examples 1 to 3 and Comparative Examples 1 to 3. The toner fusion bond to the doctor was visually observed. Image resolution, solid image uniformity and white spot images were visually evaluated. The results are shown in Tables 1 to 4.

Toner fusion bond to doctor: 5 No bond
3 Slight bond
1 Heavy bond
Image resolution: 5 Thin lines are clearly produced
3 Ordinary letters are clearly produced
1 Ordinary letters are blurred
Solid image uniformity: 5 uniform
3 Slightly nonuniform
1 Nonuniform
White spot images: 5 No spot
3 Slight spot
1 Heavy spot
4 is between 5 and 3, and 2 is between 3 and 1.

Comparative Example 1

The procedure for preparation and evaluation of the toner in Example 1 were repeated except that the resultant toner had a volume-average particle diameter of 2.8 μm, included particles having a particle diameter not greater than 4.0 μm in an amount of 28% by number, and particles having a particle diameter not greater than 2.0 μm in an amount of 15% by number, and that 2.0 parts of silica (R-972 from Clariant Japan K.K.) was mixed with the classified toner.

Comparative Example 2

The procedure for preparation and evaluation of the toner in Example 1 were repeated except that the resultant toner had a volume-average particle diameter of 6.5 μm, included particles having a particle diameter not greater than 4.0 μm in an amount of 35% by number, and particles having a particle diameter not greater than 2.0 μm in an amount of 15% by number, and that 0.75 parts of silica (R-972 from Clariant Japan K.K.) was mixed with the classified toner.

Comparative Example 3

The procedure for preparation and evaluation of the toner in Example 1 were repeated except that the developing doctor in the imagio MP5000 from Ricoh Company, Ltd. was modified to have a surface roughness Ra of 0.25.

Example 2

The procedure for preparation and evaluation of the toner in Example 1 were repeated except that the resultant toner had a volume-average particle diameter of 4.5 μm, included particles having a particle diameter not greater than 4.0 μm in an amount of 35% by number, and particles having a particle diameter not greater than 2.0 μm in an amount of 8% by number, 1.5 parts of silica (R-972 from Clariant Japan K.K.) was mixed with the classified toner, and that that the developing doctor in the imagio MP5000 from Ricoh Company, Ltd. was modified to be a stainless-formed doctor having a surface roughness Ra of 0.18.

Example 3

The procedure for preparation and evaluation of the toner in Example 1 were repeated except that the developing doctor in the imagio MP5000 from Ricoh Company, Ltd. was modified to be a doctor formed of alumite-treated aluminum, having a surface roughness Ra of 0.19.

Example 4

The procedure for preparation and evaluation of the toner in Example 2 were repeated except that the developing doctor in the imagio MP5000 from Ricoh Company, Ltd. was modified to be a doctor formed of alumite-treated aluminum, having a surface roughness Ra of 0.19.

Example 5

The procedure for preparation and evaluation of the toner in Example 2 were repeated except that the developing doctor in the imagio MP5000 from Ricoh Company, Ltd. was modified to be a doctor formed of alumite-treated aluminum, having a surface roughness Ra of 0.19, and that the recycler was on to return the toner to be recycled.

Example 6

The procedure for preparation and evaluation of the toner in Example 2 were repeated except that the developing doctor in the imagio MP5000 from Ricoh Company, Ltd. was modified to be a doctor formed of alumite-treated aluminum, having a surface roughness Ra of 0.17, and that the recycler was on to return the toner to be recycled.

TABLE 1

| Toner fusion bond to doctor | | | | |
|---|---|---|---|---|
| Toner | Start | 20,000 | 50,000 | 100,000 |
| Example 1 | 5 | 4.5 | 4 | 3.5 |
| Comparative Example 1 | 5 | 4 | 3 | 2 |
| Comparative Example 2 | 5 | 5 | 4 | 3 |
| Comparative Example 3 | 5 | 4 | 3 | 2 |
| Example 2 | 5 | 5 | 4 | 4 |
| Example 3 | 5 | 5 | 4.5 | 4 |
| Example 4 | 5 | 5 | 5 | 4 |
| Example 5 | 5 | 5 | 5 | 5 |
| Example 6 | 5 | 5 | 5 | 5 |

TABLE 2

| Image Resolution | | | | |
|---|---|---|---|---|
| Toner | Start | 20,000 | 50,000 | 100,000 |
| Example 1 | 5 | 5 | 5 | 4.5 |
| Comparative Example 1 | 5 | 4 | 3 | 3 |
| Comparative Example 2 | 4 | 4 | 3 | 3 |
| Comparative Example 3 | 5 | 4 | 4 | 3 |
| Example 2 | 5 | 5 | 5 | 4 |
| Example 3 | 5 | 5 | 5 | 4.5 |
| Example 4 | 5 | 5 | 5 | 4.5 |
| Example 5 | 5 | 5 | 5 | 5 |
| Example 6 | 5 | 5 | 5 | 5 |

TABLE 3

| Solid image uniformity | | | | |
|---|---|---|---|---|
| Toner | Start | 20,000 | 50,000 | 100,000 |
| Example 1 | 5 | 5 | 5 | 4.5 |
| Comparative Example 1 | 5 | 4 | 2 | 1.5 |
| Comparative Example 2 | 5 | 5 | 3 | 2 |
| Comparative Example 3 | 5 | 4 | 2.5 | 1.5 |
| Example 2 | 5 | 5 | 4.5 | 4 |
| Example 3 | 5 | 5 | 4.5 | 4 |
| Example 4 | 5 | 5 | 5 | 5 |
| Example 5 | 5 | 5 | 5 | 5 |
| Example 6 | 5 | 5 | 5 | 5 |

TABLE 4

| White spot images | | | | |
|---|---|---|---|---|
| Toner | Start | 20,000 | 50,000 | 100,000 |
| Example 1 | 5 | 5 | 5 | 4.5 |
| Comparative Example 1 | 5 | 4 | 3 | 2 |
| Comparative Example 2 | 5 | 5 | 4 | 3 |
| Comparative Example 3 | 5 | 4 | 3 | 2 |
| Example 2 | 5 | 5 | 5 | 4.5 |
| Example 3 | 5 | 5 | 5 | 4.5 |
| Example 4 | 5 | 5 | 5 | 5 |
| Example 5 | 5 | 5 | 5 | 5 |
| Example 6 | 5 | 5 | 5 | 5 |

This application claims priority and contains subject matter related to Japanese Patent Application No. 2010-005171, filed on Jan. 13, 2010, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A two-component developing method, comprising:

regulating a two-component developer borne on a developer bearer with a doctor blade regulation member; and transferring the regulated two-component developer to the developer bearer to develop a latent image on an image bearer, wherein the two-component developer includes a pulverized toner having a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number, and wherein the doctor blade has a surface regulating the developer at an upstream side relative to a rotational direction of the developer bearer, which has a surface roughness Ra not greater than 0.2 μm.

2. The two-component developing method of claim 1, wherein the doctor blade is formed of a non-magnetic metal.

3. The two-component developing method of claim 2, wherein the non-magnetic metal is aluminum, the surface of which is treated with alumite.

4. The two-component developing method of claim 1, further comprising:

collecting toner not transferred onto a transfer material and returning the toner into an image developer with a toner recycler.

5. A two-component image developer unit, comprising:

a developer bearer configured to bear a two-component developer; and a doctor blade regulation member configured to regulate the two-component developer on the developer bearer to develop a latent image on an image bearer, wherein the two-component developer includes a pulverized toner having a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number, and wherein the doctor blade has a surface regulating the developer at an upstream side relative to a rotational direction of the developer bearer, which has a surface roughness Ra not greater than 0.2 μm.

6. The two-component image developer unit of claim 5, wherein the doctor blade is formed of a non-magnetic metal.

7. The two-component image developer unit of claim 6, wherein the non-magnetic metal is aluminum, the surface of which is treated with alumite.

8. The two-component image developer unit of claim 5, further comprising a toner recycler configured to collect toner not transferred onto a transfer material and return the toner into the two-component image developer.

9. A process cartridge detachable from an image forming apparatus, comprising:

an image bearer on which an electrostatic latent image is formed; and the two-component image developer unit according to claim 5, configured to develop the electrostatic latent image to be visualized.

10. A two-component developer, comprising:

a toner for use in a two-component developing method comprising regulating a two-component developer borne on a developer bearer with a doctor blade regulation member and transferring the regulated two-component developer to the developer bearer to develop a latent image on an image bearer, and the doctor blade has a surface regulating the developer at an upstream side relative to a rotational direction of the developer bearer surface, which has a surface roughness Ra not greater than 0.2 μm, wherein the toner has a volume-average particle diameter of from 3.0 to 6.0 μm, including particles having a particle diameter not greater than 4.0 μm in an amount not less than 30% by number, and including particles having a particle diameter not greater than 2.0 μm in an amount not greater than 10% by number.

11. The two-component developer of claim 10, wherein the doctor blade is formed of a non-magnetic metal.

12. The two-component developer of claim 11, wherein the non-magnetic metal is aluminum, the surface of which is treated with alumite.

13. The two-component developer of claim 10, wherein the two-component developing method further comprises:

collecting the toner not transferred onto a transfer material and returning the toner into an image developer with a toner recycler.

14. A two-component developer for use in a process cartridge detachable from image forming apparatus, comprising:

an image bearer on which an electrostatic latent image is formed; and an image developer configured to develop the electrostatic latent image into a visible image with the two-component developer according to claim 10.

* * * * *